US005444994A

United States Patent [19]

Poortinga et al.

[11] Patent Number: 5,444,994

[45] Date of Patent: Aug. 29, 1995

[54] PRESSURE DISPLACEMENT DEVICE

[76] Inventors: Rhonda Poortinga; Brad C. Poortinga, both of 16538 Dartolo Rd., Ramona, Calif. 92065

[21] Appl. No.: 258,413

[22] Filed: Jun. 10, 1994

Related U.S. Application Data

[63] Continuation-in-part of Ser. No. 73,728, Jun. 8, 1993, abandoned.

[51] Int. Cl.[6] ..... A44C 7/00

[52] U.S. Cl. ..... 63/14.3

[58] Field of Search ..... 63/2, 14.2, 14.3, DIG. 3

[56] References Cited

U.S. PATENT DOCUMENTS

| | | | |
|---|---|---|---|
| 1,971,216 | 5/1934 | Gould | 63/14 |
| 1,978,652 | 10/1934 | Shea | 63/14 |
| 2,354,872 | 12/1944 | Rich | 63/12 |
| 2,510,511 | 6/1950 | Mittendorf | 63/14 |
| 2,633,440 | 3/1953 | Scholl | 154/53.5 |
| 2,763,999 | 9/1956 | Norman | 63/14 |
| 2,775,014 | 12/1956 | Gollobin | 63/14.3 |
| 2,795,118 | 6/1957 | Shill | 63/14.3 |
| 2,819,595 | 1/1958 | Northup | 63/14.3 |
| 2,879,567 | 3/1959 | O'Connell | 24/5 |
| 2,936,600 | 5/1960 | Crigler | 63/14 |
| 2,952,998 | 9/1960 | Lawrence | 63/14.3 |
| 2,975,538 | 3/1961 | Murfin | 40/20 |
| 3,238,936 | 3/1966 | Jurgovan | 128/76 |
| 4,974,430 | 12/1990 | Turner | 63/12 |
| 4,993,240 | 2/1991 | Pounder | 16/12 |
| 5,044,176 | 9/1991 | King | 16/12 |
| 5,081,853 | 1/1992 | Salyer | 63/DIG. 1 |

*Primary Examiner*—Michael J. Milano

[57] ABSTRACT

A device for displacing the pressure caused at the point of contact of the clip of a clip-on earring comprises a strip of pliant material having a non-adhesive outer surface. The device is long enough to wrap around the bottom of the earlobe and is secured to the earlobe by either a mild adhesive, or the earring clip itself. It is wide enough to displace the pressure of the clip. The pliant material comprises an added built up substance, creating a safety shelf for the clip-on earring to rest upon, preventing lateral movement. The device is wide enough for periodic adjustment of the earring for maximum comfort throughout the day, but not to cause unwanted attention to the device.

11 Claims, 4 Drawing Sheets

PRESSURE DISPLACEMENT DEVICE

This is a continuation-in-part of our application Ser. No. 08/073,728 filed Jun. 8, 1993 now abandoned.

BACKGROUND—FIELD OF INVENTION

This invention relates to a device used in conjunction with clip-on earrings, specifically a device for relieving the pressure caused by clip-on earrings.

BACKGROUND—DESCRIPTION OF PRIOR ART

Clip-on earrings are designed to be attached to the earlobe by a clip squeezing the earlobe. This method of attaching the earring to the earlobe often causes pain.

Many women are sensitive to the pain caused by the pressure of clip-on earrings. Clip-on earrings will often bite into the skin of the earlobe, leaving painful marks which extend to the bottom of the earlobe. Thus, Many persons wear clip-on earrings for short periods of time only and cannot endure the pain for an entire day. Currently the most common method of easing the pain is to take the earrings off periodically to give the earlobes a rest. Unfortunately on many occasions, such as business meetings and social gatherings, it is awkward for the wearer to remove the earrings.

A popular method of displacing pressure is by using a tension loosening key, currently on the market, to loosen the tension on clip-on earrings. While this does reduces some of the pressure, it also causes problems. When a clip is loosened enough to relieve sufficient pressure, it also causes the earring to slip downward or to fall off. If the earring is then tightened enough to stay in place, the painful pressure returns.

Several other ways have been proposed to relieve pressure of clip-on earrings. U.S. Pat. No. 1,971,16 to Gould (1934) is a screw-on earring with its own pad and relates to screw-on earrings only. The earring wearer that could utilize Gould's device must wear the screw-on earrings that have the old type of round ended screw back to allow it to fit into the back of round hole described in Gould's earring retainer. Due to the size and shape of a clip of an average clip-on earring, a clip would not fit into the screw-head size hole described in Gould's. Gould does not mention and his device is not intended for use in conjunction with clip-on earrings. Gould's device does not extend to the bottom of the earlobe to protect against pressure from a clip-on earring, rendering Goulds device useless in a clip-on earring application. U.S. Pat. No. 1,978,652 to Shea (1934) is a device that uses vacuum cups secured to a flexible connecting member for connecting the earring to the ear. Vacuum cups are limited to a specific area and do not displace the pressure.

U.S. Pat. No. 2,364,872 to Rich (1943) discloses an ornament which is hollow and has a fastening element on the back as to attach an adhesive strip which may be secured to the wearer's earlobe. This limits the wearer to a specific type of ornament, not a clip-on earring.

U.S. Pat. No. 2,510511 to Mittendorf (1950) is an earring by itself, made of a resilient of a beryllium-copper alloy which may be coated with precious metal. Mittendorf's device has a front plate and back plate with the U-shaped beryllium-copper or electroplated wire welded or soldered to these plates as to hang below the earlobe in a ring-shaped structure. The spring tension of the ring shaped-structure provides the pressure to keep Mittendorf's earring in place. Since Mittendor's device uses tension to keep the earring in place, wearing an additional clip-on earring over Mittendorf's device would only create added pressure to the earlobe, causing the wearer even more pain.

U.S. Pat. No. 2,633,440 to Scholl (1953) shows a double-faced adhesive tape used primarily for securing clothing. The adhesive is strong enough to give the wearer a feeling of security and must be waterproof to hold up strapless brassiere elements or swimsuit.

U.S. Pat. No. 2,763,999 to Norman (1953) is a thick earring pad plus, a metallic ring for concealing the pad, that attaches to earrings. The type of pad that is used by Norman is very wide, adding the metallic ring further increases the thickness. There are many earring pads on the market that are very similar to Norman's. Tests prove that the type of pads described by Norman actually causes the clip-on earring to have a tighter grip since the clip-on is being forced open double the width of an average earlobe or more. Within minutes of wearing this type of pad, the pain from the pressure is just as intense as not having the pad at all. Clip-on earrings will give the wearer painful pressure marks all the way to the bottom of the earlobe. Norman's does not extend to the bottom of the earlobe. Norman's cannot wrap around the bottom of the earlobe.

U.S. Pat. No. 2,879,567 to O'Connell (1959) shows a corsage holder. The corsage holder must have sufficient dimensions for supporting a corsage and would not fit on an earlobe. The corsage holder does not describe any use for ears or earrings. The corsage holder is for the wrist or shoulder area. U.S. Pat. No. 2,936,600 to Crigler (1960) discloses an adhesive strip fastened to the concha of the ear, not the earlobe. The adhesive strip has a connector eye extending downward for receiving a connector pin for attaching an ornament or an earring. This is another alternative for attaching an earring to the ear. U.S. Pat. No. 2,975,583 to Murfin (1960) relates to an emblem and a means for mounting it to a car, boot, or other types of equipment. Ears and earrings are not mentioned. U.S. Pat. No. 3,238,936 to Jurgovan (1966) is a device for supporting tissues of the face by taping the sagging part of the jaw line and opposite ends of the mouth. It accomplishes this by using pieces of tape $\frac{3}{4}$ inch by $\frac{3}{4}$ inch or smaller, hoping to give the look of a facelift. Although Jugoran uses adhesively attached ear ornaments, they are merely to conceal the tape used for supporting the sagging tissue. Jurgovan's device must use an adhesive strong enough too hold sagging skin all day.

U.S. Pat. No. 4,974,430 to Turner (1990) is for an adhesively secured earring. Turner's support has two basic uses. The first is to adhesively secure an ornament or clip-on earring to the human ear. Turner's process calls for adhesive covering part of the face of the support to connect the ornament. Turner's process must also have a strong enough adhesive on the back to adhere to the ear and support the weight of the ornament or earring. Removing a strong adhesive tape is very painful and irritating to the skin on the earlobe, especially if it has been squeezed by a clip-on earring for any amount of time. Adhesive on the outside surface of Turner's support will cause hair to stick to that adhesive. Having to pull hair off the face of a two-sided adhesive tape is painful and damaging to the hair causing breakage. In addition, having an adhesive tape on the outside surface of the support that is removed repeatedly from the earring, will over a period of time remove the plating of the earring. Having the earring adhesively secured to the ear will prohibit the wearer with sensitive earlobes from easily moving or sliding the earring to the position on the support for maximum comfort throughout the day. Since Turner's is meant to support the ornament or clip-on earring, having the adhesive adhere to the ornament or clip-on earring is mandatory.

Loosening clip-on earrings using a special clip-on earring key that is on the market is a very popular method of decreasing the painful pressure of clip-on earrings without adhering them to the earlobe. Loosening the clip will cause the earring to slip or fall off more easily. Even after loosening the clip there is still uncomfortable pressure on the earlobe. Thus, there is a need for displacement of the painful pressure. There is an even greater need to supply added safety from slippage,which would result in loss of the loosened earring. Turners device does not supply a means for blocking the loosened clip-on earring from slipping off. The second use for Turners invention is to provide support for pierced earrings. Pierced earrings do not cause pressure on the earlobe and would not need pressure displacement.

U.S. Pat. No. 4,993,240 to Pounder (1991) describes a facial adornment which is worn over the top of the ear and then extends the ornamental portion forward and down the front of the ear or along side of the face. This facial adornment then wraps around the entire back of the ear to be attached to the earlobe with an earring. Pounder's facial adornment is meant to be a large visible part of the decoration of the ear.

U.S. Pat. No. 5,044,176 Patent to King (1991) shows a support cradle for pierced earrings. As King describes in the background description, the cradle is supporting the weight of the pierced earring to keep the post from tearing the pierced opening in the wearers earlobe. King's support does not apply to or mention clip-on earrings. The V-shaped notches at the top of each side of King's support are not referenced in her art and do not serve any purpose. King's support is formed out of metal or hardened material and cannot be manipulated out of the molded shape. With King's support the earlobe must conform to the device.

Some of the above devices rely upon an outer adhesive to support the clip-on earring. All such devices are known to suffer from a number of disadvantages:

(a) Having an adhesive on the outside of a device causes hair to stick to the device, causing breakage to the hair when removing it from the device. It is not worth the aggravation of having to go through this annoying procedure. Having a device with the adhesive on the outside will cause adhesive to be exposed, and the wearer will be pulling hair from the device all day. Even pulling on or two hairs from the device is too annoying to tolerate for most earring wearers. Most earring wearers prefer taking the earrings off to using this type of annoying device with the adhesive on the outside surface.

(b) Most clip-on earrings are costume jewelry. This means most clip-on earrings will only be plated or only electroplated with 10 k, 14 k or 18 k gold. This type of plating is known to easily wear off. Using a device with an adhesive on the outside to adhesively support the clip-on earring will cause the plating of the clip-on earring to wear off much faster.

(c) Many people with sensitive earlobes must adjust the earring in the middle of the day no matter how much pressure has been displaced or padding has been used. As for the wearer being able to adjust the clip-on earring in the middle of the day, once a device is adhesively attached to the earlobe and adhesively attached to the earring, the earring and the device must be removed from the earlobe then reattached. This process causes additional irritation to an already sore earlobe. Since the adhesive prevents a simple adjustment, the wearer again will choose to remove their clip-on earrings.

OBJECTS AND ADVANTAGES

Several objects and advantages of the present invention are:

(a) to provide a device that is strong enough to displace the pressure and pain a clip-on earring causes, (b) to provide a device that allows one to wear the clip-on earrings of their choice, including clip-on earrings previously worn without our device, (c) to provide a device without adhesive on the outer surface, since repeated removal of adhesive from an earring causes the plating on the clip-on earring to be destroyed, (d) to provide a device without adhesive on the outer surface of the device, (An outer adhesive would cause hair to stick to the outside of the device throughout the day. Having to remove hair from an adhesive is painful and damaging to the hair, causing breakage.)

(e) to provide a device with a mild adhesive that is on one side only, (This adhesive should be so delicate that it can be removed relatively painlessly even after a full day's pressure from the clip-on earrings.)

(f) to provide a device to displace the painful pressure that clip-on earrings cause. (Clip-on earrings can leave painful dents in the earlobes that can cause soreness for days. This soreness sometimes makes it impossible to wear clip-on earrings two days in a row.)

(g) to provide a device that makes clip-on earrings comfortable, (The device will alleviate the need to take off clip-on earrings during business meetings, social engagements, or other functions because the pressure and pain have been displaced.)

(h) to provide a device that allows people with sensitive earlobes to wear clip-on earrings many hours longer than without our device, (The device featuring a large enough area to allow adjustment in the middle of the day for extra sensitive earlobes. This area will still be small enough not to cause attention to the device. This feature is needed by many people who could previously only stand to wear clip-on earrings 45 minutes or less without our device.)

(i) to provide an economical, disposable device for sanitary reasons since earrings are known to easily and quickly build up crusty dirty deposits, (Wearing the present device will greatly diminish the grimy build up problem and keep any dirt on the clip-on earring away from the earlobe, while displacing the pressure.)

(j) to provide a device made of a material that is pliable enough to conform to the natural curves of the earlobe, (k) to provide a device with a unique safety-shelf feature that allows the wearer to wear the clip-on earring above the shelf, creating a barrier against unintentional force that may cause a clip-on earring to slip downward or fall off, such as using a phone or brushing hair away, (l) to provide a device with a unique safety shelf feature that will allow a clip-on earring wearer to rest their slightly loose or loosened clip-on earring upon the safety shelf while the remaining pressure from the clip is displaced by the device, and (m) to provide a device that wraps from the front of the earlobe to the back protecting the entire area of the earlobe that a clip-on earring comes into contact with, including the underside of the earlobe.

DRAWING FIGURES

Figure 1:
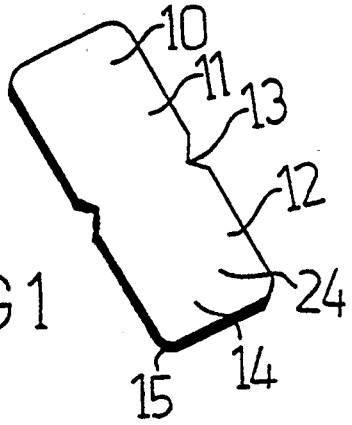
FIG. 1 shows a perspective view of a preferred embodiment of a pressure displacement device according to our invention.

| Reference Numerals In Drawings | | | |
|---|---|---|---|
| 10 | outer surface | 11 | front portion |
| 12 | back portion | 13 | v-shaped notches |
| 14 | rectangular in shape | 15 | round corners |
| 16 | inner surface with adhesive | 17 | earlobe |
| 18 | earring | 19 | inner surface w/o adhesive |
| 20 | removable liner | 21 | clip portion of earring |
| 22 | safety shelf | 23 | plating on earring |
| 24 | transparent | 25 | variety of colors |
| 26 | ear | 27 | different shapes |
| 28 | non-adhesive surface | | |

DESCRIPTION—FIGS. 1,2,3,4,6,7,8,9

FIG. 1 shows a pressure displacement device made of a transparent 24 pliant material that should be lightly textured on the outer surface 10 of the front portion 11 and back portion 12 for traction and easy grip and guide for tearing to smaller size if needed. The outer surface 10 of the pliant material must be without adhesive on both the front portion 11 and back portion 12. This feature will prevent hair from sticking to the device throughout the day. This feature will also prevent the device from causing wear to the plating 23 of an earring 18. The earring 18 is not included in the present invention. The front portion 11 and back portion 12 of the device are typically ½ inch in width and ⅞ inch in length which is approximately equivalent to 12 mm in width and 223 mm in length. This area allows the wearer enough room for adjustment without causing attention to the device.

Figure 2:
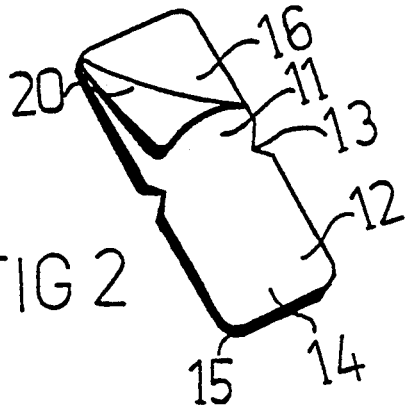
FIG. 2 shows a perspective view of an inner surface of the device, supplied with a weak adhesive and removable backing.

FIGS. 1 and FIG. 2 illustrate the two small notches 13, typically V-shaped, on each side of the device between top portion 11 and bottom portion 12 to allow the wearer to bend the pliant material easily around earlobe 17. Notches 13 make the device less noticeable by giving it a more tailored fit. Front portion 11 and back portion 12 of the device are typically rectangular in shape 14 with rounded corners 15.

Figure 3:
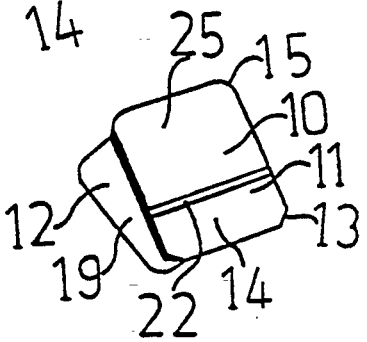
FIG. 3 shows a perspective view of the pressure displacement device without an adhesive.

Two typical embodiments of the inner surface are illustrated in FIGS. 2 and FIG. 3. Inner surfaces 16 and 19 show the area of the device that will come in contact with earlobe 17. Inner surface 16 in FIG. 2 has a weak adhesive. This will be a pressure-sensitive hypoallergenic adhesive material, such as supplied by pharmaceutical or medical tape manufacturers. The adhesive should be mild for easy removal after a full day's pressure from a clip-on earring. The pressure displacement device may supply this feature of easy removal, since this mild adhesive is only meant to hold the device in place, not secure an earring. The securement of an earring relies on the pressure from earring 21.

FIG. 2 illustrates a typical embodiment of a removable liner 20 partially peeled back. Liner 20 will protect the mild adhesive from foreign objects, such as dirt or dust during storage or travel.

FIG. 3 illustrates a device without an adhesive. FIG. 3 also illustrates a device shaped and ready for use. V-shaped notches 13 provide easy shaping.

FIGS. 1 and 3 illustrate a typical embodiment of a safety shelf 22 of a predetermined thickness on the front portion and back portion of the device for aiding and holding the clip-on earring.

Figure 4:
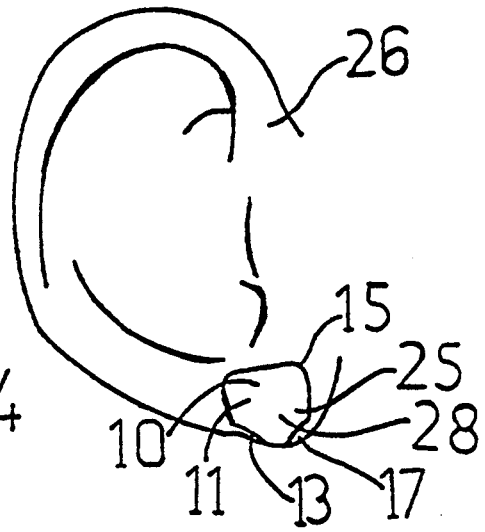
FIG. 4 shows a perspective view of a device secured to an earlobe by a weak adhesive.

FIG. 4 illustrates a device of in one of the variety of colors 25.

Figure 6:
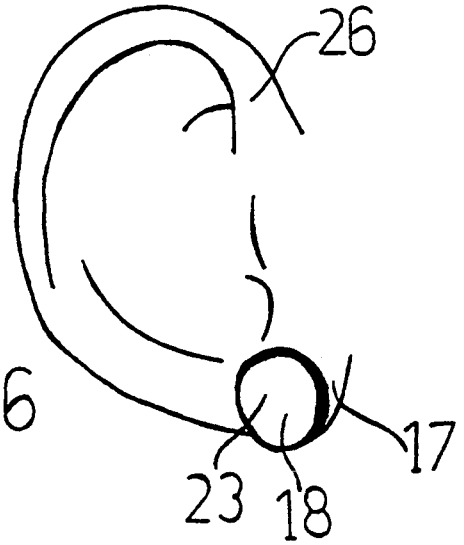
FIG. 6 shows a perspective view of a clip-on earring over a pressure displacement device resting on a safety shelf the device being with or without adhesive.

FIG. 6 illustrates the plating on the earring 23 that is protected from wear by the use of non-adhesive surface 28.

Figure 7:
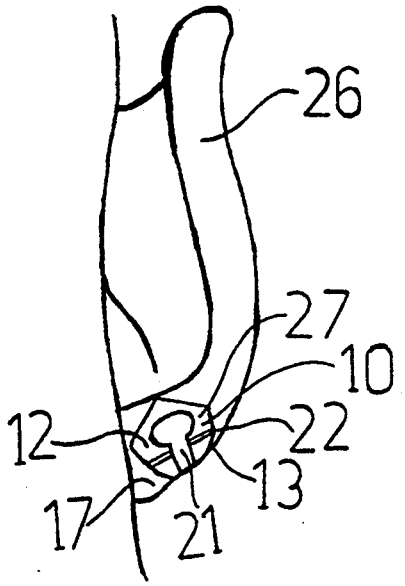
FIG. 7 shows a perspective rear view of a clip-on earring over a pressure displacement device resting on the safety shelf the device being with or without adhesive.
Figure 8:
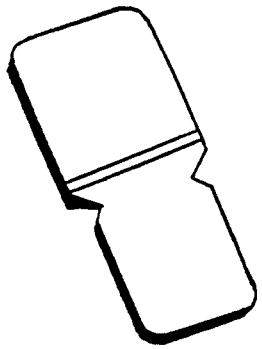
FIG. 8 shows a perspective view of a device front and back with different sizes.
Figure 9:
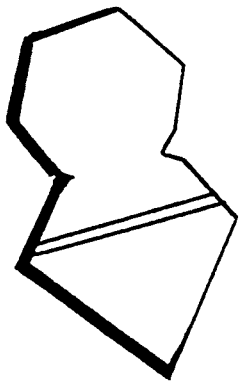
FIG. 9 shows a perspective view of a device front and back with different shapes.

FIG. 7 illustrates a clip-on earring 18 after it has been placed above shelf 22 to prevent the earring from slipping laterally and falling from the ear 26. FIG. 7 also illustrate a device with a different shape 27. FIG. 8 shows device front and back with different sizes. FIG. 9 shows device front and back with different shapes.

From the description above, a number of advantages of our pressure displacement device become evident:

(a) A material which is transparent eliminates the need to try to match many different flesh tones.

(b) The device can be made of a material that may also be offered in many different colors.

(c) A preferred rectangular shape with rounded corners on both the front portion and back portion of the device provide the wearer of clip-on earrings with enough coverage to allow for simple adjustments throughout the day for maximum comfort. The rectangular shape allows the wearer an approximate area of 12 mm ×23 mm to easily slide the earring to the desired position on the front and back of the earlobe, achieving maximum comfort. This area is large enough to effectively displace the pressure caused by most clip-on earrings without causing attention to the device.

(d) The device is designed with two V-shaped or similar shaped notches for simple shaping and placement. These notches work well in tailoring the device while giving the earlobe maximum coverage for maximum comfort.

(e) The device does not require that any specially made earrings be used in with it. The device is purposely designed to be used with any clip-on earrings.

(f) The outside surface of the device does not have an adhesive. This feature will prevent the plating on the earring to wear or be destroyed. This feature will also prevent hair from sticking to the device throughout the day.

(g) With the use of removable backing to cover the mild adhesive on the inner surface, one can easily store or travel with the device without allowing foreign objects, such as dirt and dust, to stick to the device.

(h) The use of a delicate texture on the outside surface of the device will help supply traction to the clip on the clip-on earring.

(i) The mildness of the adhesive on the inner face of the device will give the wearer an easy way to place the device on the earlobe without having to worry about the pain that will be caused when removing a device needing a stronger adhesive.

(j) The device provides an economical disposable device that blocks the earring from coming into contact with the earlobe, preventing dirty deposits from building upon clip-on earrings.

(k) The device provides a unique safety shelf feature that allows the wearer to wear the earrings above the shelf on the device creating a barrier against unintentional force that may cause a clip-on earring to slip downward or fall off.

(l) The device has a unique safety shelf feature that will allow a clip-on earring wearer to rest their slightly loose or loosened clip-on earrings on the safety shelf while the remaining pressure from the clip is displaced by the pressure displacement device.

(m) Since this device wraps from the front of the earlobe to the back, it protects the entire area of the earlobe that a clip-on earring comes into contact with, including the underside of the earlobe.

Operation—FIGS. 2 to 7

Figure 5:
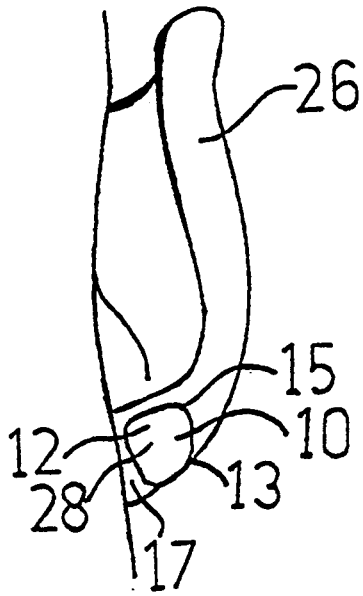
FIG. 5 shows a perspective rear view of a device secured to an earlobe with a weak adhesive.

FIG. 2 illustrates the method of using a displacement device that has a mild adhesive on inner surface 16. One first peels back removable liner 20 to reveal mild adhesive 16. Next, one applies the inner surface 16 of front portion 11 to the front of earlobe 17. Continue by bending the device around the bottom of earlobe 17 so that V-shaped notches 13 are at the base of earlobe 17 and secure, as shown in FIG. 4. Continue bending back portion 12 of the device around to the back of earlobe 17 and secure it, as shown in FIG. 5. A clip-on earring 18 may now be worn over the device by clipping the clip of earring 21 over the device and above safety shelf 22 and then moving earring 18 by simply sliding it to the desired area on the device for maximum comfort and desired visual effect, as shown in FIGS. 6 and 7. Earring 18 is now in place. Earring 18 may be worn in this position for the rest of the day. Wearers with extra-sensitive earlobes may need to simply slide earring 18 to another area on the device after a few hours to have maximum comfort and desired visual effect for the rest of the day. A popular remedy for even further reduced pressure is to loosen clip 21. By loosening the clip the wearer has greater danger of having earring 18 slip off. By securing the slightly loosened clip-on earring above safety shelf 22, earring 18 will have an extra barrier to shield from slipping down or falling off.

To remove the device, one first removes earring 18 in the usual manner. Then one peels the device from the front of earlobe 17 in the same manner as removing a small bandage from the skin, peeling the device down one side and up the other or by peeling both sides down earlobe 17. This process should be virtually painless since the adhesive preferred by the current device is mild and hypoallergenic as offered by medical suppliers for painless removal.

As shown in FIG. 3, when using a pressure displacement device without adhesive one must first bend the device at V-shaped notches 13. Next place the device around the base of earlobe 17 as shown in FIG. 4. Next place the device around the bottom of earlobe 17 as shown in FIG. 5, but this time hold the device in place, preferably with one's thumb and forefinger. To continue to secure the device, clip-on earring 18 as shown in FIG. 6 over the non-adhesive 28 surface of the device and above safety shelf 22. Then, use the pressure of clip 21 as shown in FIG. 7 to hold both the earring and the device on the earlobe. This non-adhesive 28 ramification also allows for adjustment to maximum comfort and desired visual effect, and will not cause plating 23 of the earring 18 to wear off.

To remove the device, begin by removing the clip-on 18 from earlobe 17 in the usual manner. The device will usually fall off as earring 18 is removed from earlobe 17 unless one holds the device in place with one's thumb and forefinger for further use.

Summary, Ramifications, and Scope

Accordingly, the reader will see that the pressure displacement device can be used in conjunction with any clip-on earring. In addition the pressure displacement device is an economical, disposable means of displacing the pain so many people suffer from when wearing clip-on earrings. Also we provide a safety shelf for cradling the earring to prevent lateral slipping.

Furthermore, the pressure displacement device has the additional advantages in that

* It provides a solution to people with sensitive earlobes, helping to make it possible to enjoy wearing clip-on earrings for longer periods of time.
* It provides a pressure displacement device that has as adhesive on one side that is so mild that it can be removed virtually painlessly, even after a full day of the pressure from a clip-on earring.
* It provides a device that does not have an adhesive that comes in contact with the earring, eliminating the possibility of having the plating on the earring damaged or destroyed, due to the use of the device.
* It provides a device that does not have adhesive on the outside surface of the device. Adhesive on the outside surface of the device causes hair to stick to the device throughout the day.
* It provides a device that should alleviate the need to take off clip-on earrings during business meetings, social events, dates, or other functions because the pressure and pain have been displaced.
* It provides a device that has a safety shelf for the clip-on earring to rest upon. This safety shelf provides a great advantage to clip-on earring wearers that experience their earrings slipping down or falling off due to unintentional force such as brushing hair back or using the phone.

* It provides a device that clip-on earring wearers can use to prevent slipping after slightly loosening the clip for reduced pressure. Loosening the clip is a popular method for reducing pressure but this method causes earrings to slip downward. The safety shelf on the device helps shield the clip-on earring from lateral movement, that could cause the earring to fall off, while displacing the remaining pressure.

Although the above description above contains many specificities, these should not be construed as limiting the scope of the invention but merely providing illustrations of some of the presently preferred embodiments of this invention. For example the device can come in a variety of shapes, such as figure eight, a rectangle, etc. Also the device may be made in a variety of colors.

Thus, the scope this invention should be determined by the appended claims and their legal equivalents, rather than the examples given.

I claim:

1. A pressure displacement device for aiding in holding a clip-on earring, comprising a strip of pliant material of a predetermined thickness having central small V-shaped notches to provide a more conforming fit, said notches being shaped so as to allow for maximum coverage of said device from front, underneath, and around to the back of wearer's earlobe, said device having a front portion and rear portion with a non-adhesive surface of sufficient area to allow for periodic adjustment of a clip-on earring so the wearer of said earring may slide said earring to a more comfortable area on said strip of pliant material without removing said earring, said strip of pliant material comprises a portion having a thickness greater than said predetermined thickness said portion having a ledge facing outwardly to create a safety shelf upon which said earring can rest, whereby said shelf prevents said earring from lateral movement and falling off.

2. A device as defined in claim 1 wherein the safety shelf is on the front portion's outer surface.

3. A device as defined in claim 1 wherein the safety shelf is on the back portions outer surface.

4. A device as defined in claim 1 wherein the safety shelf is on the front and back portions outer surface.

5. A device a defined in claim 1 wherein said pliant material of said strip includes a layer of adhesive for removable securing said pliant material to said earlobe.

6. A device a defined in claim 1 wherein said pliant material is transparent.

7. A device as defined in claim 1 wherein said pliant material is of a variety of colors.

8. A device as defined in claim 1 wherein said pliant material comprises releasable cover means over the adhesive surface of said strip.

9. A device as defined in claim 1 wherein said pliant material comprises an enlarged front portion and an enlarged back portion of equal sizes.

10. A device as defined in claim 1 wherein said pliant material comprises an enlarged front portion and an enlarged back portion of unequal sizes.

11. A device as defined in claim 1 wherein said pliant material comprises enlarged front portion and enlarged back portion of different shapes.

* * * * *